US005716305A

United States Patent [19]

Selsam

[11] Patent Number: 5,716,305

[45] Date of Patent: Feb. 10, 1998

[54] MULTI-PURPOSE EXERCISE DEVICE

[76] Inventor: Douglas Spriggs Selsam, 8211 Michael Dr., Huntington Beach, Calif. 92647

[21] Appl. No.: 681,727

[22] Filed: Jul. 29, 1996

[51] Int. Cl.[6] ..... A63B 21/06

[52] U.S. Cl. ..... 482/93; 482/106; 482/52; 482/140; 482/141

[58] Field of Search ..... 482/52, 93, 106, 482/108, 140–142; D21/191, 196, 197

[56] References Cited

U.S. PATENT DOCUMENTS

| | | | |
|---|---|---|---|
| D. 267,737 | 1/1983 | Wright | D21/197 |
| 1,019,584 | 3/1912 | Balston . | |
| 1,366,200 | 1/1921 | Matysek . | |
| 3,734,493 | 5/1973 | Hasekian . | |
| 4,029,312 | 6/1977 | Wright . | |
| 4,212,458 | 7/1980 | Bizilia . | |
| 4,575,074 | 3/1986 | Damratoski . | |
| 4,673,179 | 6/1987 | Pengler | 482/93 |
| 4,679,788 | 7/1987 | Adler . | |
| 4,722,523 | 2/1988 | Yang . | |
| 4,743,018 | 5/1988 | Eckler | 482/106 |
| 4,773,640 | 9/1988 | Kolbel et al. | 482/108 |
| 4,826,151 | 5/1989 | Nuredin . | |
| 5,158,512 | 10/1992 | Irwin et al. . | |
| 5,318,489 | 6/1994 | Irwin . | |
| 5,393,284 | 2/1995 | Wesley . | |

*Primary Examiner*—Richard J. Apley
*Assistant Examiner*—John Mulcahy

[57] ABSTRACT

A multiple use exercise device is formed as a closable hollow container which may be filled with a ballast substance, such as water, by the end user. The hollow container is penetrated at each end by a recess. The central portion of each recess is spanned by a handle, giving the device utility as a barbell. A central cutout, shaped to accomodate the trunk of the user, enhances this utility by making the container easier for the user to hold close to the body, and by increasing the range of motion possible at full extension and contraction, during exercises normally performed with a barbell. A flat surface, located on the side of the container opposite the central cutout, serves as a stepping surface for the performance of stair stepping type exercises. A pair of voids, penetrating the container from the central cutout to the flat stepping surface, are shaped to accept the insertion of the user's feet from either the top or the bottom. When the feet are inserted from the bottom, the device exerts a downward force on them, facilitating the performance of situps or leg extensions. When the feet are inserted from the top, they are elevated and anchored as a fulcrum for the enhanced performance of pushups. The device facilitates or enhances the performance of curls, presses, rows, squats, arm extensions and most other exercises possible with a barbell, as well as pushups, situps, leg extensions and stair stepping type exercises.

30 Claims, 14 Drawing Sheets

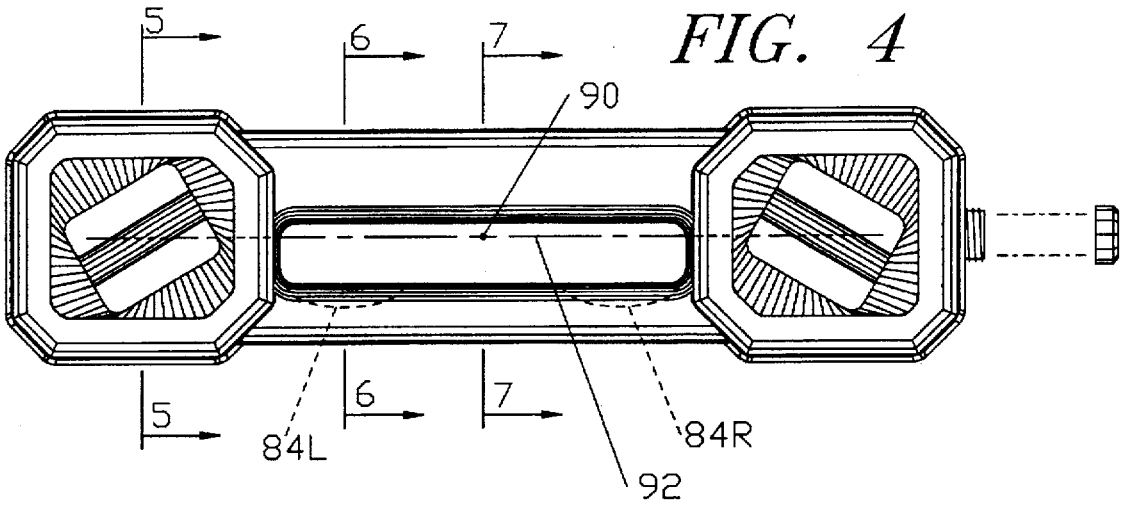
FIG. 4
FIG. 5
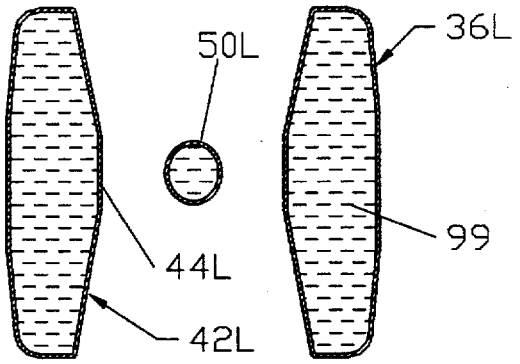
FIG. 6
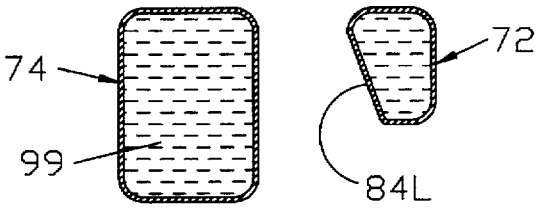
FIG. 7
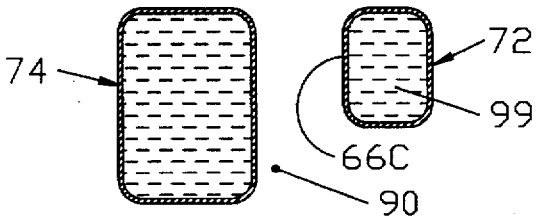
FIG. 8
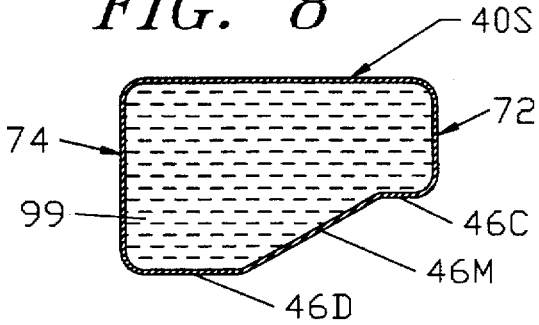

MULTI-PURPOSE EXERCISE DEVICE

BACKGROUND OF THE INVENTION

1. Field of the Invention

The present invention relates to exercising equipment, specifically to barbells, situp devices, pushup devices, weights for attachment to the feet, and stepping structures for aerobic exercise.

2. Description of the Prior Art

Traditionally, the performance of a comprehensive and varied exercise regimen for the physical conditioning of a variety of muscles has involved the use of either free weights, a multiplicity of devices, each directed toward a specific class of exercises, or large, complicated, and cumbersome, multiple use machines which are expensive to manufacture and ship. It is seen as desirable in the field of fitness products to have a single device which is inexpensive to produce, lightweight for shipping purposes, and which facilitates a wide variety of exercises to enhance total fitness and well being.

Barbells and dumbells, while facilitating a wide variety of exercises, are normally expensive to manufacture and ship, due to their intrinsic mass. Attempts to reduce the shipping mass of barbells through the use of hollow weights, fillable by the end user with ballast such as water, sand, shot, and the like, have still required a conventional bar, which is usually made of metal, and therefore heavy and expensive to ship. Unitary, hollow, fillable dumbells provide a partial solution to the problem of requiring a separate conventional bar, particularly when the integrated handle is located within a central recess, so that rigidity of the unit is attained without relying on the strength of the handle alone, however dumbells do not lend themselves to all of the same exercises as barbells. Neither barbells nor dumbells alone may be conveniently attached to the feet without the use of ancillary devices, nor are they of use as stepping types of devices for aerobic conditioning.

U.S. Pat. No. 1,019,584 to Balston discloses a rigid barbell or dumbell having fillable end sections threadably attached to a connecting bar. This early embodiment of the concept of a fillable barbell had utility limited to that of traditional barbells and dumbells, and was not useful for situps, leg lifts, pushups, or as a stepping type of device. The device had multiple sections including a separate, conventional bar and therefore could not be manufactured as a single unit. The conventional bar had inherently high shipping weight.

U.S. Pat. No. 1,366,200 to Matysek discloses fillable dumbells, attachable to a bar to constitute a barbell. This device is designed to be gripped by the hands only, and is not useful for situps, leg lifts, pushups, or as a stepping type of device. This device also had multiple sections including a separate, conventional bar and therefore could not be manufactured as a single unit. Here again, the conventional bar has an inherently high shipping weight.

U.S. Pat. No. 3,734,493 to Hasekian discloses a molded, one piece dumbell incorporating an integral platform with restraining straps for the feet. While useful for both traditional dumbell exercises, and for situps and leg extensions, this device is not useful as a barbell, as a stepping type of device, or for pushups, and is not specified as fillable by the end user, so is expensive to manufacture and ship.

U.S. Pat. No. 4,029,312 to Wright discloses a pair of fillable dumbells which can be mounted on a rigid bar to constitute a barbell. Recesses located in the center of each dumbell provide access to either hands or feet without requiring attachments or alterations, providing convenient versatility. These dumbells are relatively lightweight when empty, and therefore this combination is less expensive to manufacture and ship than conventional weights. Disadvantages of this combination are that it incorporates a conventional bar, which does not lend itself to being formed by the same molding process as the dumbells, and that it is composed of three main parts, and so in any case cannot be molded as a single unit. The conventional bar has inherently high shipping weight. Also, the handles must be oriented to telescopically receive the bar, while it is generally recognized that handles oriented at an angle to the longitudinal axis of the bar are more comfortable for many exercises. Note that this invention is not useful for pushups, and lacks utility as an aerobic stepping type of device.

U.S. Pat. No. 4,212,458 to Bizilia discloses one example of the many devices designed to anchor the feet of a user during the performance of situps, by attachment to the underside of a door. While useful for this designated purpose, it lacks utility for other types of exercises.

U.S. Pat. No. 4,575,074 to Damratoski discloses a one piece molded fillable dumbell which may be used as either a hand or foot weight. While relatively inexpensive to produce and ship, it lacks utility as a barbell or as an aerobic stepping type of device. It also does not aid in the execution of pushups.

U.S. Pat. No. 4,679,788 to Adler discloses an exercise device having a weighted and padded cross arm on a post extending up from the base of the device. The base is designed for insertion under a bed mattress. Its primary use is to hold the feet of a user down during the performance of situps. It also has limited utility for leg exercises and as a relatively lightweight barbell. This device must be assembled from several distinct parts, and since its weight cannot be increased by the addition of ballast by the end user, is not particularly cheap to manufacture or ship.

U.S. Pat. No. 4,722,523 to Yang discloses a multiple use exercise kit which facilitates a wide variety of exercises. While quite versatile, this combination of many parts, including metal bars and weight plates, is heavy and expensive to produce and ship. It is also quite complicated to use, requiring reconfiguration between different types of exercise.

U.S. Pat. No. 4,826,151 to Nuredin discloses an ankle supporting stand for elevating the feet of a user, providing enhanced effectiveness in the performance of pushups. While well suited for its intended purpose, this device, by itself, does not facilitate a well rounded exercise regimen.

U.S. Pat. Nos. 5,158,512 and 5,318,489 to Irwin et al disclose a stepping type of device for aerobic exercise. While elegant in its design and well suited to its purpose, it lacks utility for other types of exercise.

U.S. Pat. No. 5,393,284 to Wesley discloses a flexible, fillable barbell which may be reconfigured to become rigid by the insertion of a conventional bar. Straps for attachment to the feet are included. This device is portable and versatile, but must be reconfigured for different uses, and is not useful for pushups, situps, or as a stepping type of device. Also, the conventional bar has inherently high shipping weight.

SUMMARY OF THE INVENTION

A primary object of the present invention is to provide a versatile fitness product, facilitating a complete and varied exercise regimen, which can be produced in large numbers at low cost, and which is lightweight for shipping purposes.

A second object of this invention is to provide a moldable, single unit barbell type of device which can be filled with a ballast material, such as water, by the end user.

Another object of this invention is to provide a moldable barbell type of device, the main body of which can be produced as a single unit, rather than as a multiple piece assembly.

Another object of the invention is to provide a unitary, moldable, multiple use fitness device with proper draft angles such that it may be produced using conventional blow molding techniques from a two piece mold.

A further object of this invention is to provide a single unit barbell type of device with built in handles which does not require the use of a conventional bar.

A still further object of this invention is to provide a fillable barbell type of device in which the longitudinal axis of each handle may be at a nonzero angle to the longitudinal axis of the unit as a whole.

An additional object of the present invention is to provide a single unit barbell type of device which has recesses shaped for receiving the feet of a user from below, so that it is useful in the performance of situps, leg extensions, and the like.

A related object of the present invention is to provide a moldable, single unit device which can be used to hold down the feet of a user during the performance of situps by its weight alone, without attachment to other objects.

Another related object of the present invention is to provide a single unit barbell type of device which has recesses shaped for receiving the feet of a user from above, so that it has the added function of elevating and anchoring a user's feet for the purpose of enhancing the effectiveness of pushups.

A still further object of the present invention is to provide a single unit barbell type of device which also has utility as a stepping type of device for aerobic exercise.

One more object of the present invention is to provide a simple, easy to use fitness device which may be employed in a variety of exercises such as curls, presses, tricep extensions, bent over rows, squats, and other traditional barbell exercises, as well as pushups, situps, leg extensions, stair stepping routines, etc., without reconfiguration between exercises.

Yet another object of the present invention is to provide a versatile, multiple use exercise device which is compact and easy to store.

Yet one more object of the present invention is to provide a versatile, multiple use exercise device which is less likely than metal weights to cause personal injury or property damage if accidentally dropped.

In accordance with the foregoing objectives, a single unit, moldable, multiple use exercise device is disclosed, fillable with a ballast substance such as water by the end user. Herein is disclosed a versatile device having true utility as a freeweight type of barbell, which may be inexpensively manufactured and shipped, with the additional advantages that it may be used for situps, pushups, leg extensions, and stair stepping type exercises.

Since the device may be emptied and refilled at any time, and indeed, may even be used as an interim container for foodstuffs, fuel, or beverages, it is ideal as a fitness device when traveling, or on extended expeditions or camping trips.

Still further objects and advantages will become apparent from a consideration of the ensuing description and drawings.

BRIEF DESCRIPTION OF THE DRAWING FIGURES

FIG. 4 is a top plan view of the first embodiment of the present invention, showing section lines.

FIG. 5 is a sectional view of the present invention.

FIG. 6 is a sectional view of the first and second embodiments of the present invention.

FIG. 7 is a sectional view of the first embodiment of the present invention.

FIG. 8 is a sectional view of the second embodiment of the present invention.

DETAILED DESCRIPTION OF THE PREFERRED EMBODIMENTS

Figure 1:
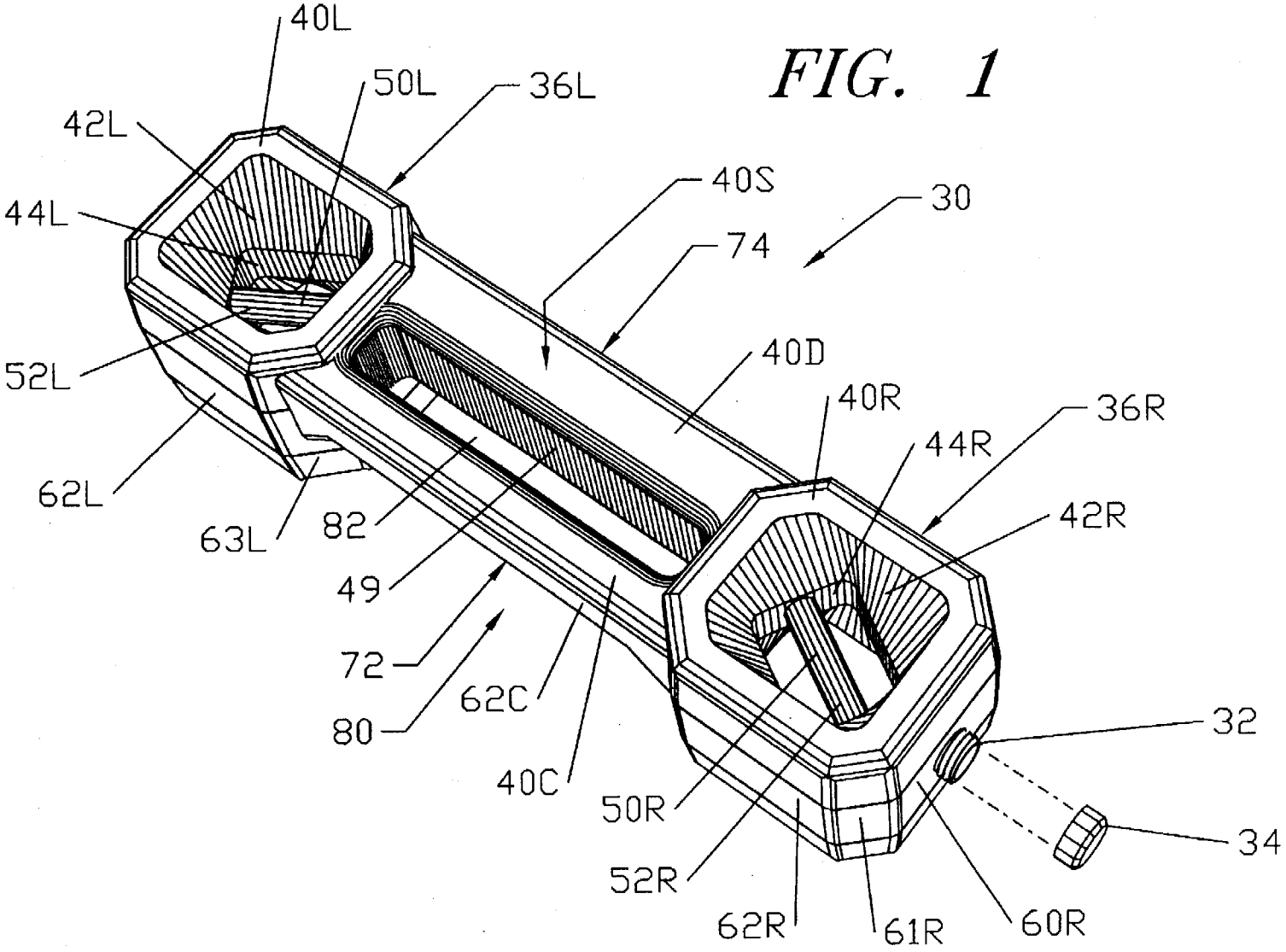
FIG. 1 is a perspective view of the first embodiment of the present invention, taken from the upper right front.
Figure 2:
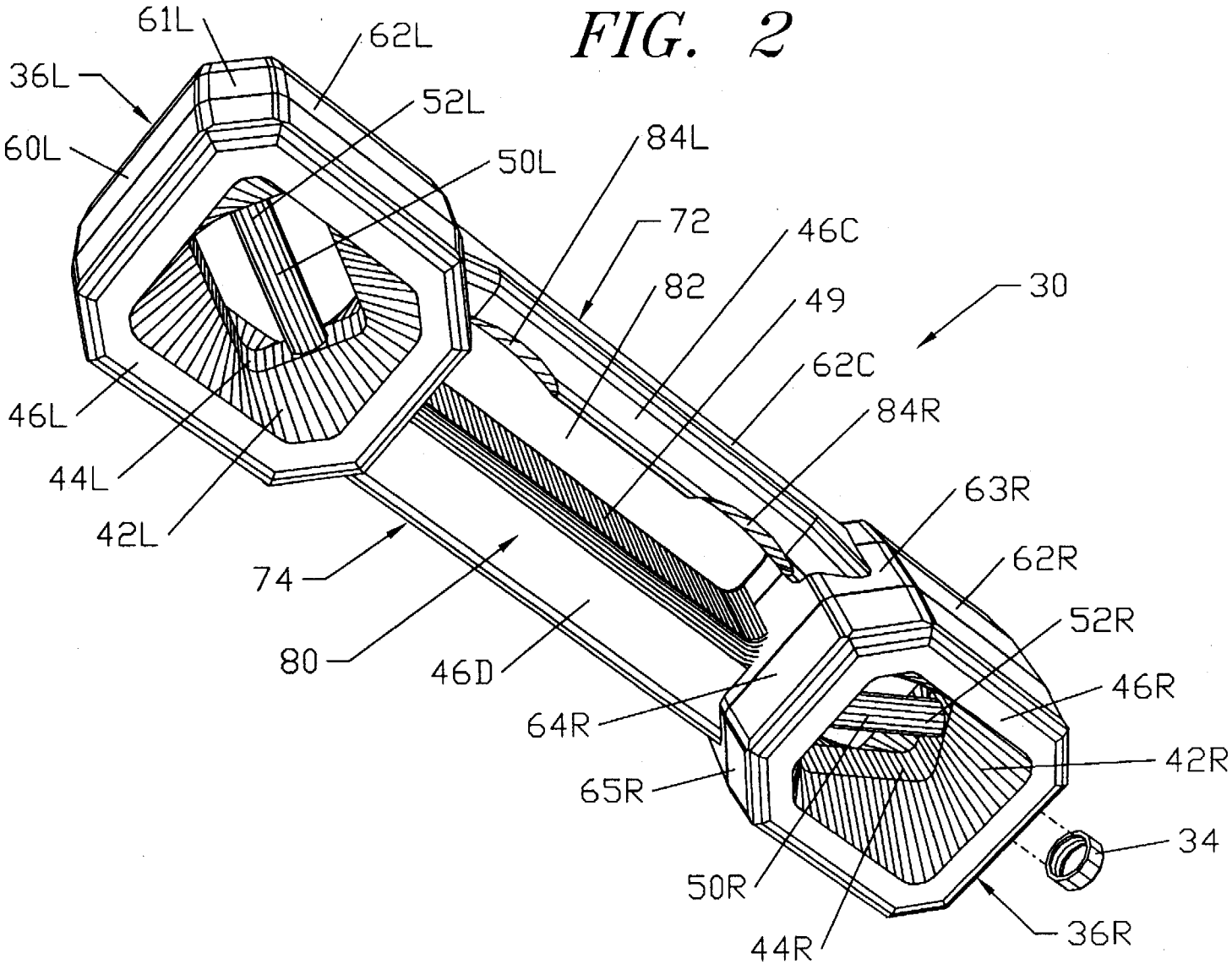
FIG. 2 is a perspective view of the first embodiment of the present invention, taken from the lower left front.
Figure 3:
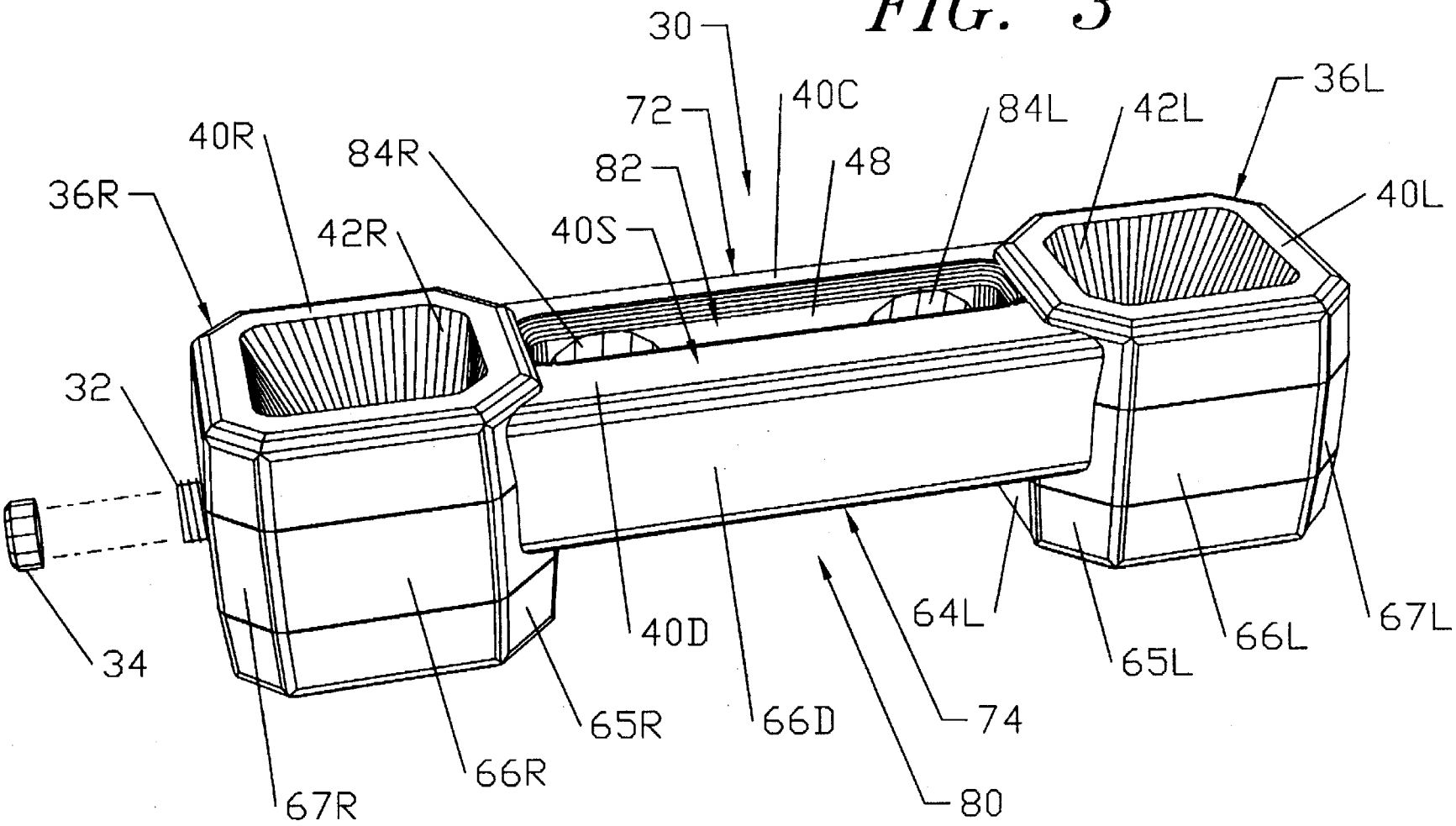
FIG. 3 is a perspective view of the first embodiment of the present invention, taken from the upper right rear.
Figure 9:
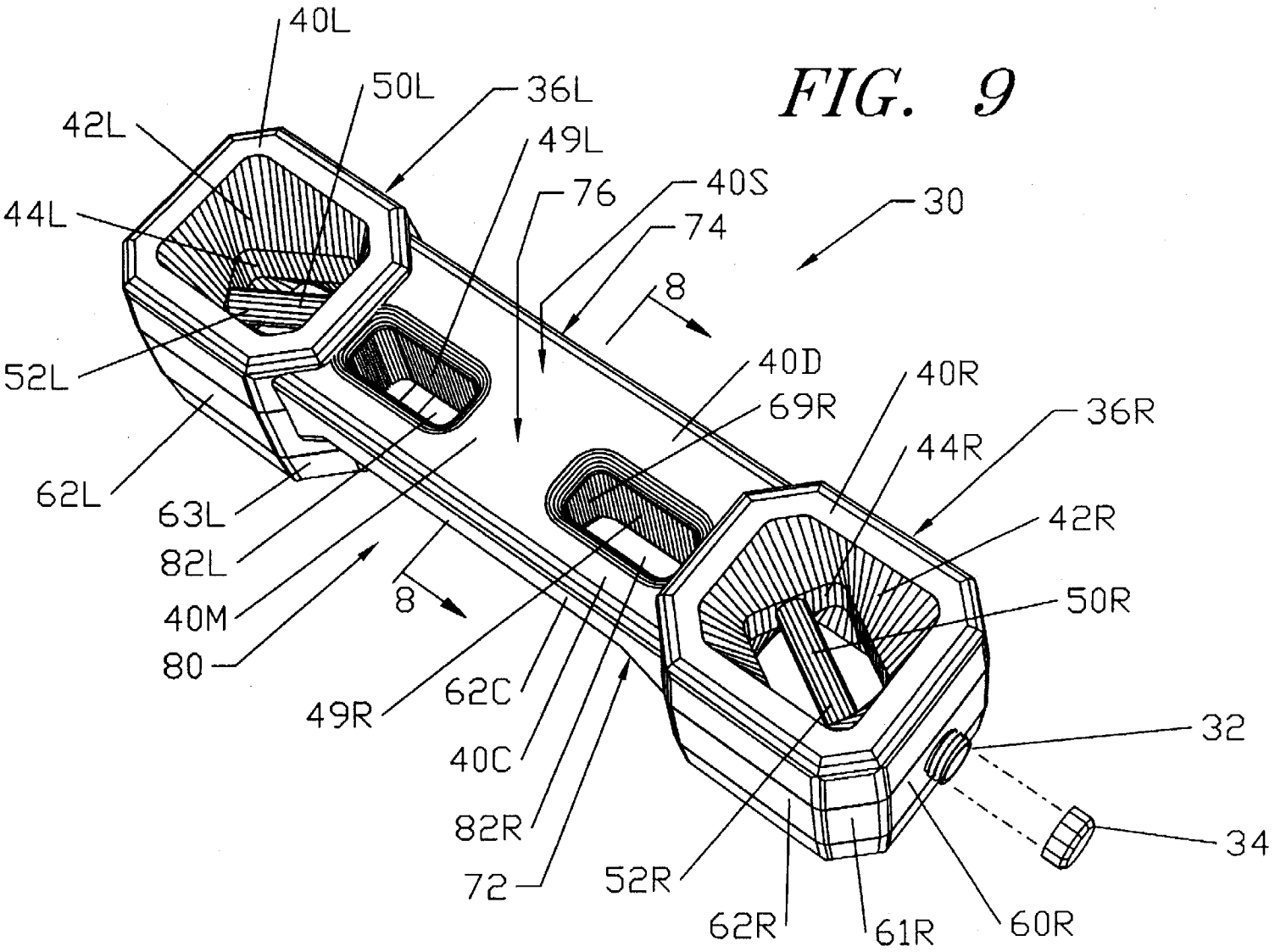
FIG. 9 is a perspective view of the second embodiment of the present invention, taken from the upper right front.
Figure 10:
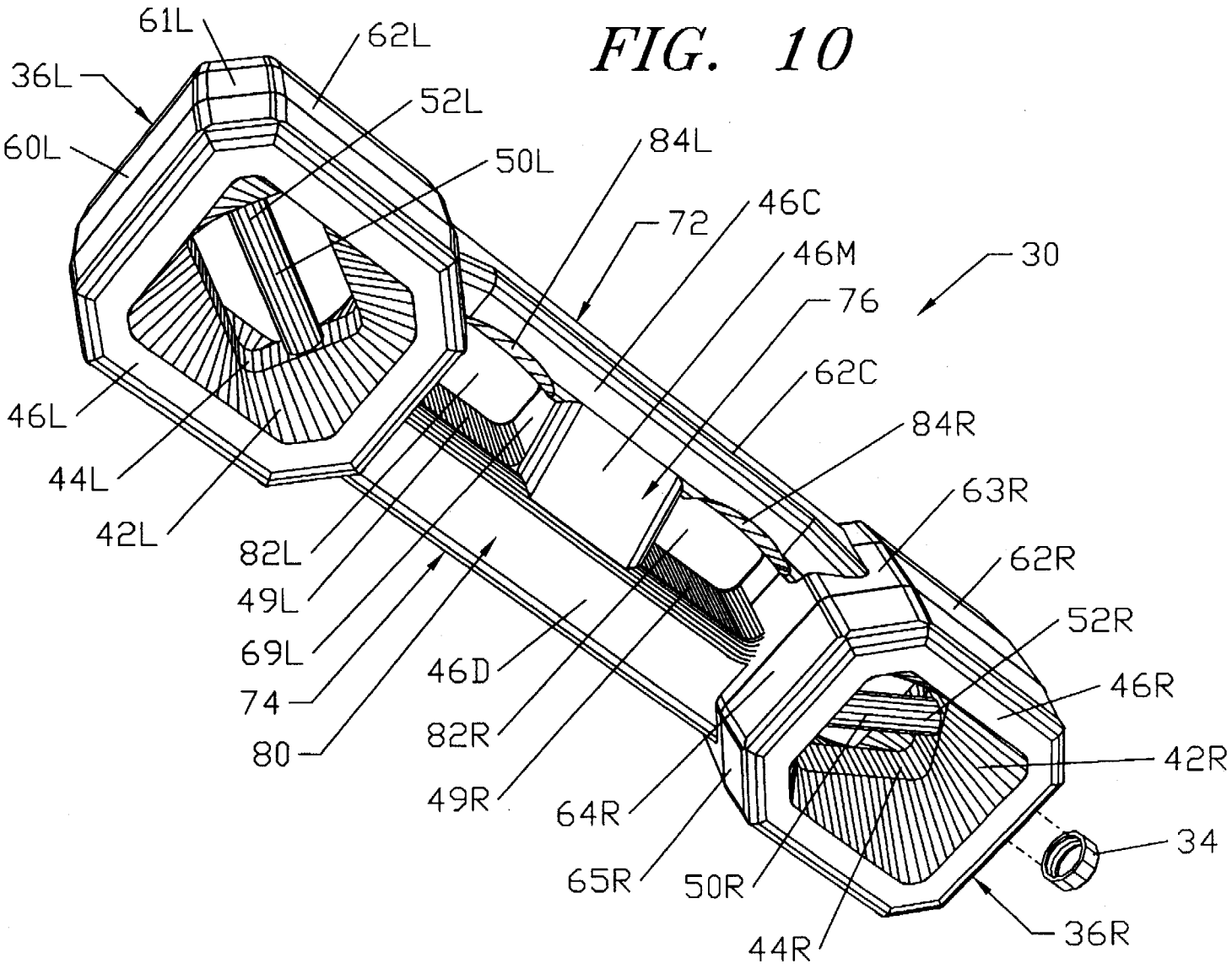
FIG. 10 is a perspective view of the second embodiment of the present invention, taken from the lower left front.
Figure 11:
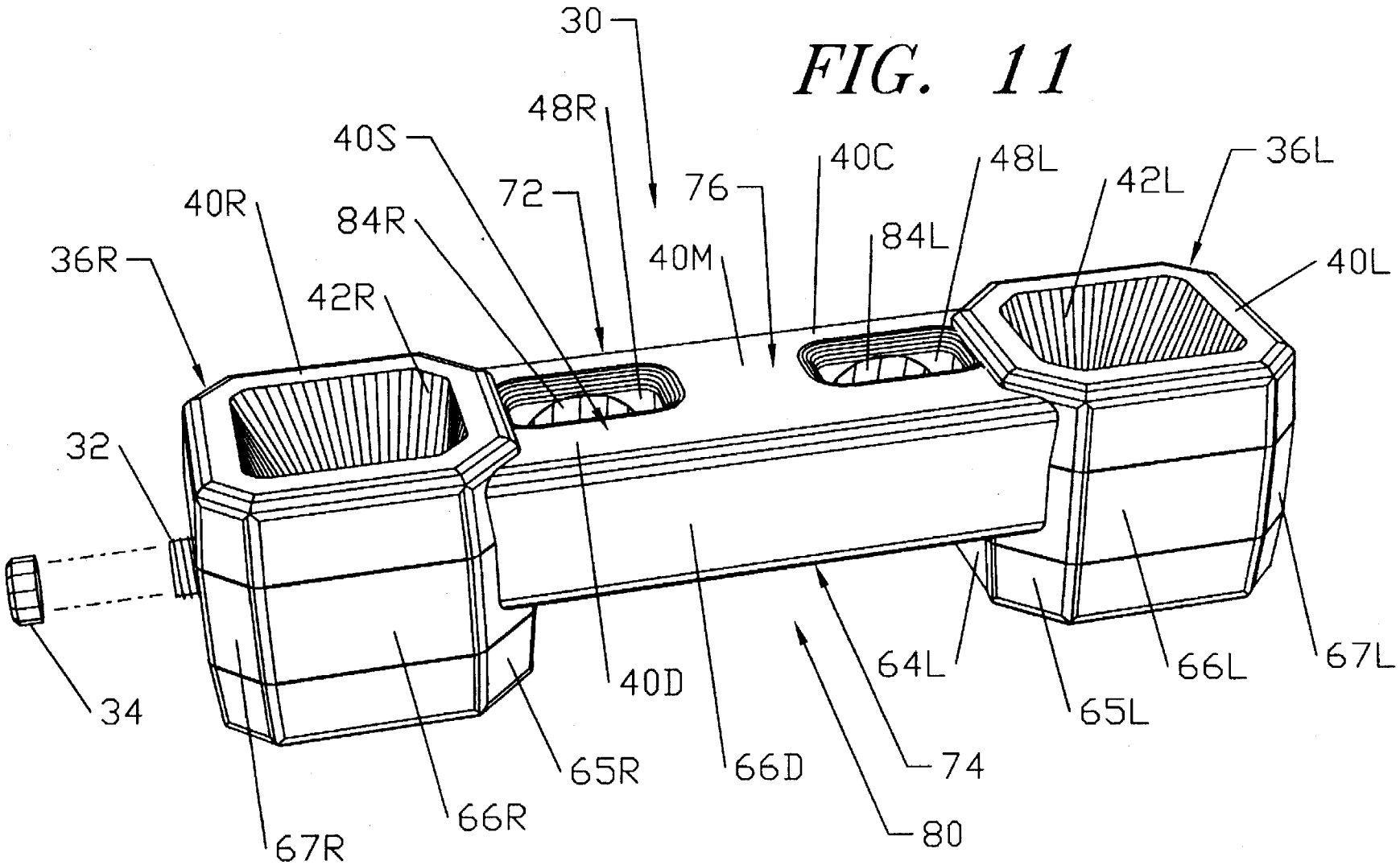
FIG. 11 is a perspective view of the second embodiment of the present invention, taken from the upper right rear.

The design of the present invention, a multiple use exercise device, is optimized to be produced as a single, durable, specially shaped container, to be filled with a pourable ballast substance such as water, sand, or shot by the end user. Notwithstanding this fact, it should be understood that the general design discussed here could easily be filled with a similar ballast substance at the point of manufacture, or at any convenient point along the distribution chain. In addition, a product with this general design could be filled with a hardening, or cementitious ballast substance at the point of manufacture, as are many conventional weightlifting products, or even simply be produced as a solid unit, either from a molding or machining process.

Regardless of the intricacies of the different embodiments discussed, each of the preferred embodiments of the present invention is, in its simplest essence, a plastic bottle with a cap, and may be manufactured in the same manner as are other heavy duty bottles, jugs, and containers. As is well known in the art, most plastic bottles are preferentially produced by the technique of blow molding, ideally from a two piece mold. The present invention has been designed to be easily produced from a two piece mold using conventional blow molding techniques.

Reference should now be made to the drawing figures, on which similar or identical elements are given consistent identifying numerals throughout the various figures thereof. References to figure numbers direct the reader to the view(s) on which the element(s) being described is (are) best seen, although the element(s) may also be seen on other views.

While the words top, bottom, left, right, front, and rear will be used to refer to surfaces and members described herein, it is to be understood that these descriptive terms are used only in the context of orientation of the device in the illustrations under discussion, as during the many exercises for which it is designed, the present invention is to be used in a multiplicity of orientations. Similarly, the words vertical and horizontal will be used to describe the present invention oriented as illustrated in the figures under discussion.

Due to the fact that it is designed in large part for engagement by both hands or both feet simultaneously, the present invention should be understood to exhibit approximate mirror symmetry from left to right, with the exception of the fill nozzle and cap. Similar structures and features will be numbered with the letter suffixes L and R when they differ only in their left/right mirror symmetry.

While most of the surfaces comprising the present invention are not in the strictest sense planar, but are ergonomically contoured, having for instance a slight bulge outward, the words parallel, orthogonal, and flush will be used in a best effort to describe the general orientation of these surfaces, with the understanding that these words are used in an approximate sense. When two surfaces are described as parallel and opposed, any deviation from planar can be understood to be approximately opposite from the one surface to the other.

Referring to FIGS. 1–16, a preferred embodiment, and four closely related alternative embodiments of the present invention are illustrated:

A first embodiment is shown in FIGS. 1–7. An oblong hollow vessel body 30 having a left end surface 60L and an opposite, parallel, fight end surface 60R is configured for being filled with a ballast substance 99 through threaded fill nozzle 32, which is closable by threaded fill cap 34. Threaded fill nozzle 32 is approximately centered on, and protrudes outward from, right end surface 60R. Oblong hollow vessel body 30 is comprised of two primary volumes 36L and 36R, front transverse member 72, and rear transverse member 74. Primary volumes 36L and 36R are located at opposite ends of, and are fluidly attached to, front and rear transverse members 72 and 74, which are parallel.

Primary volumes 36L and 36R have the previously mentioned end surfaces 60L and 60R, in addition to front surfaces 62L and 62R, inward facing surfaces 64L and 64R, rear surfaces 66L and 66R, top surfaces 40L and 40R, and bottom surfaces 46L and 46R, respectively. Front surfaces 62L and 62R are parallel to, and opposed to rear surfaces 66L and 66R, respectively. Top surfaces 40L and 40R are parallel to, and opposed to bottom surfaces 46L and 46R, respectively. Inward facing surfaces 64L and 64R are parallel and opposed to one another, in addition to being parallel to, and opposed to end surfaces 60L and 60R, respectively. End surfaces 60L, 60R, and inward facing surfaces 64L, 64R are orthogonal to all surfaces described as top, bottom, front, or rear. All surfaces described as top or bottom are orthogonal to all surfaces described as front or rear.

The interfaces between end surfaces 60L, 60R and front surfaces 62L, 62R, respectively are chamfered at 45 degrees, forming chamfer surfaces 61L, 61R, respectively. The interfaces between front surfaces 62L, 62R and inward facing surfaces 64L, 64R, respectively are chamfered at 45 degrees, forming chamfer surfaces 63L, 63R, respectively. The interfaces between inward facing surfaces 64L, 64R, and rear surfaces 66L, 66R, respectively are chamfered at 45 degrees, forming chamfer surfaces 65L, 65R, respectively. The interfaces between rear surfaces 66L, 66R and end surfaces 60L, 60R, respectively are chamfered at 45 degrees, forming chamfer surfaces 67L, 67R, respectively.

Hand access recesses 42L and 42R vertically penetrate and are located within primary volumes 36L and 36R, respectively, and extend from top surfaces 40L and 40R, respectively to bottom surfaces 46L and 46R, respectively. Handles 50L and 50R are located within, are fluidly attached to, and extend across hand access recesses 42L and 42R, respectively, and are preferentially located approximately along a longitudinal axis 92 (FIG. 4) of oblong hollow vessel body 30 which passes through the center of mass 90 (FIGS. 4 and 7) of the combination of oblong hollow vessel body 30 and the ballast material 99 which it contains when full. The handles are basically cylindrical in shape, and may have a circular or elliptical cross section. If the cross section is elliptical, the major axis is preferentially oriented substantially vertically, or in the direction normal to the top and bottom surfaces 40L, 40R, 46L, and 46R. Each handle is advantageously oriented so that its longitudinal axis is substantially horizontal, that is, parallel to the top and bottom surfaces, and at an angle of about thirty degrees within the horizontal plane from the longitudinal axis of oblong hollow vessel body 30, such that the outer ends 52L and 52R of the handles are closer to front surfaces 62L and 62R, respectively, than to rear surfaces 66L and 66R, respectively.

The portions of hand access recesses 42L and 42R immediately surrounding the handles are denoted as hand access recess midsections 44L and 44R. Each hand access recess midsection comprises a closed band, surrounding and aligned with the handle, which in a plan view, (FIG. 4) has the shape of a rounded rectangle, the longer sides of which are parallel to the handle. Each hand access recess midsection is of a proper size and shape to provide space for an easy and unencumbered grip of the handle from above or below, with the user located to the front or the rear, by an average to large human hand. Each of the hand access recesses 42L, 42R are shaped to form a smooth transition between the top surfaces 40L, 40R, the midsections 44L, 44R, and the bottom surfaces 46L, 46R, respectively.

Transverse members 72 and 74 are fluidly attached to, and extend between primary volumes 36L and 36R. The transverse members connect to the primary volumes substantially toward the tops of the primary volumes, creating a substantial space below the transverse members and between primary volumes. The space below transverse members 72 and 74, and between primary volumes 36L, and 36R is denoted as user's trunk accomodation central cutout 80. Front transverse member 72 has a front surface 62C, a bottom surface 46C, a rear surface 48, and a top surface 40C. Rear transverse member 74 has a front surface 49, a bottom surface 46D, a rear surface 66D, and a top surface, 40D. Rear transverse member 74 is more substantial than front transverse member 72, being thicker from front to rear, as well as taller from top to bottom than front transverse member 72.

Transverse members 72 and 74 are attached to primary volumes 36L and 36R, such that transverse top surfaces 40C and 40D are parallel to, and inset downward from top surfaces 40L and 40R. The combination of top surfaces 40C and 40D is denoted as stepping surface 40S. Top surface 40C intersects with the top portions of inward facing surfaces 64L, and 64R, and chamfer surfaces 63L and 63R. Top surface 40D intersects with the top portions of inward facing surfaces 64L, and 64R, and chamfer surfaces 65L and 65R. The combination of transverse top surfaces 40C and 40D will be denoted as stepping surface 40S, which is preferentially textured with a nonskid surface. Front transverse member 72 is attached to primary volumes 36L and 36R such that front surface 62C is parallel to and inset toward the rear from front surfaces 62L and 62R. Front transverse surface 62C intersects with chamfer surfaces 63L and 63R. Rear transverse member 74 is attached to primary volumes 36L and 36R such that rear transverse surface 66D is parallel to, and inset toward the front from rear surfaces 66L and 66R.

The space between the front and rear transverse members, bounded by rear surface 48 of front transverse member 72, front surface 49 of rear transverse member 74, and inward facing surfaces 64L and 64R is denoted as foot insertion void 82. Rear surface 48 of front transverse member 72 has two foot arch indentations 84L and 84R, one located toward each end, which are smoothly shaped to accomodate the shape of the arch portion of the tops of a user's shoed feet when the shoed feet are inserted toe first into foot insertion void 82 from below, with the soles of the shoed feet against rear transverse member's front surface 49. Foot arch indentations 84L and 84R are generally trough shaped, and are at an angle, preferably less than 30 degrees from vertical, such that they are most pronounced where rear surface 48 meets bottom surface 46C, then get less pronounced as they extend upward along rear surface 48, and merge with the otherwise generally planar rear surface 48 before reaching the top of rear surface 48, where rear surface 48 meets upper surface 40C.

The intersections of transverse bottom surfaces 46C and 46D with primary volumes 36L and 36R at inward facing surfaces 64L and 64R, are gradual, smooth, and filleted to add strength and stiffness to the structure as a whole. The interfaces of transverse bottom surface 46C with primary volumes 36L and 36R at chamfer surfaces 63L and 63R are themselves chamfered and filleted to add strength and stiffness to the structure as a whole. The interfaces of transverse bottom surfaces 46D with primary volumes 36L and 36R at chamfer surfaces 65L and 65R are themselves chamfered to add strength and stiffness to the structure as a whole. In addition, the interfaces and intersections of all other surfaces are smooth, rounded, and gradual as appropriate to facilitate: (a) ease of manufacture by the method of blow molding, (b) increased strength, durability, and resistance to breakage, (c) ease, comfort, and safety of use, (d) a smooth and attractive appearance.

A second embodiment, shown in FIGS. 8–11 is similar to the first embodiment, except that instead of having a single long foot insertion void for two feet, it comprises two foot insertion voids, 82L and 82R, each sized to accept a single shoed foot. In this version of the present invention, front and rear transverse members 72 and 74 are bridged at their centers by middle connecting member 76, which extends from one transverse member to the other, dividing the space between them equally into two foot insertion voids 82L and 82R. Middle connecting member 76 has a top surface 40M, a bottom surface 46M, and side surfaces 69L and 69R. Top surface 40M is coplanar with, and smoothly merges with transverse top surfaces 40C and 40D, these three surfaces together comprising stepping surface 40S. Bottom surface 46M is flush with, and merges with transverse bottom surfaces 46C, and 46D, smoothly transitioning from one to the other. The surface which was denoted as 48 in the first embodiment is divided by middle connecting member 76 in this embodiment into surfaces 48L and 48R. The surface denoted as 49 in the first embodiment is divided by connecting member 76 in this embodiment into surfaces 49L and 49R. Surfaces 69L and 69R extend from surfaces 48L and 48R respectively, to surfaces 49L and 49R respectively.

Figure 12:
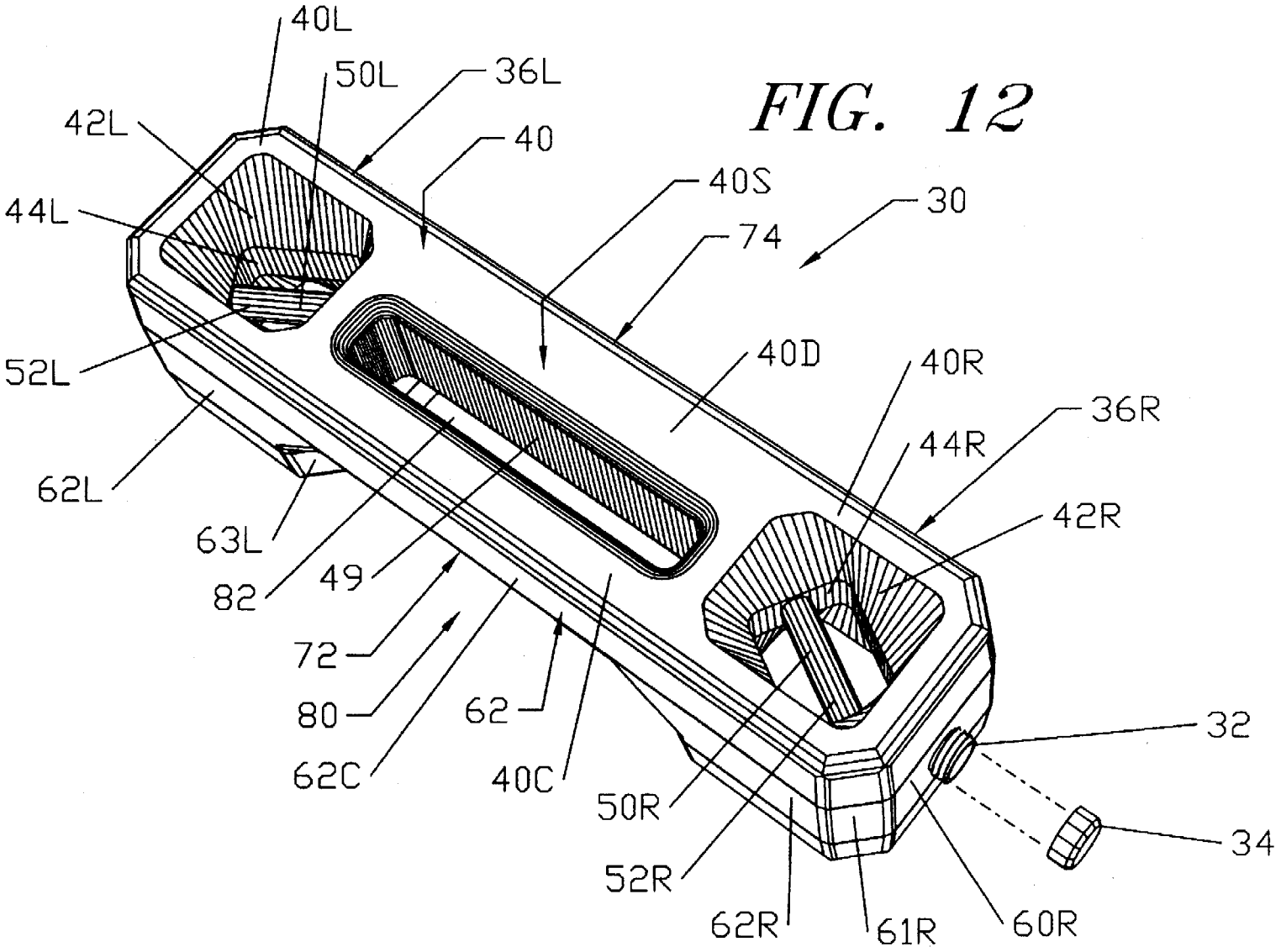
FIG. 12 is a perspective view of the third embodiment of the present invention, taken from the upper fight front.
Figure 13:
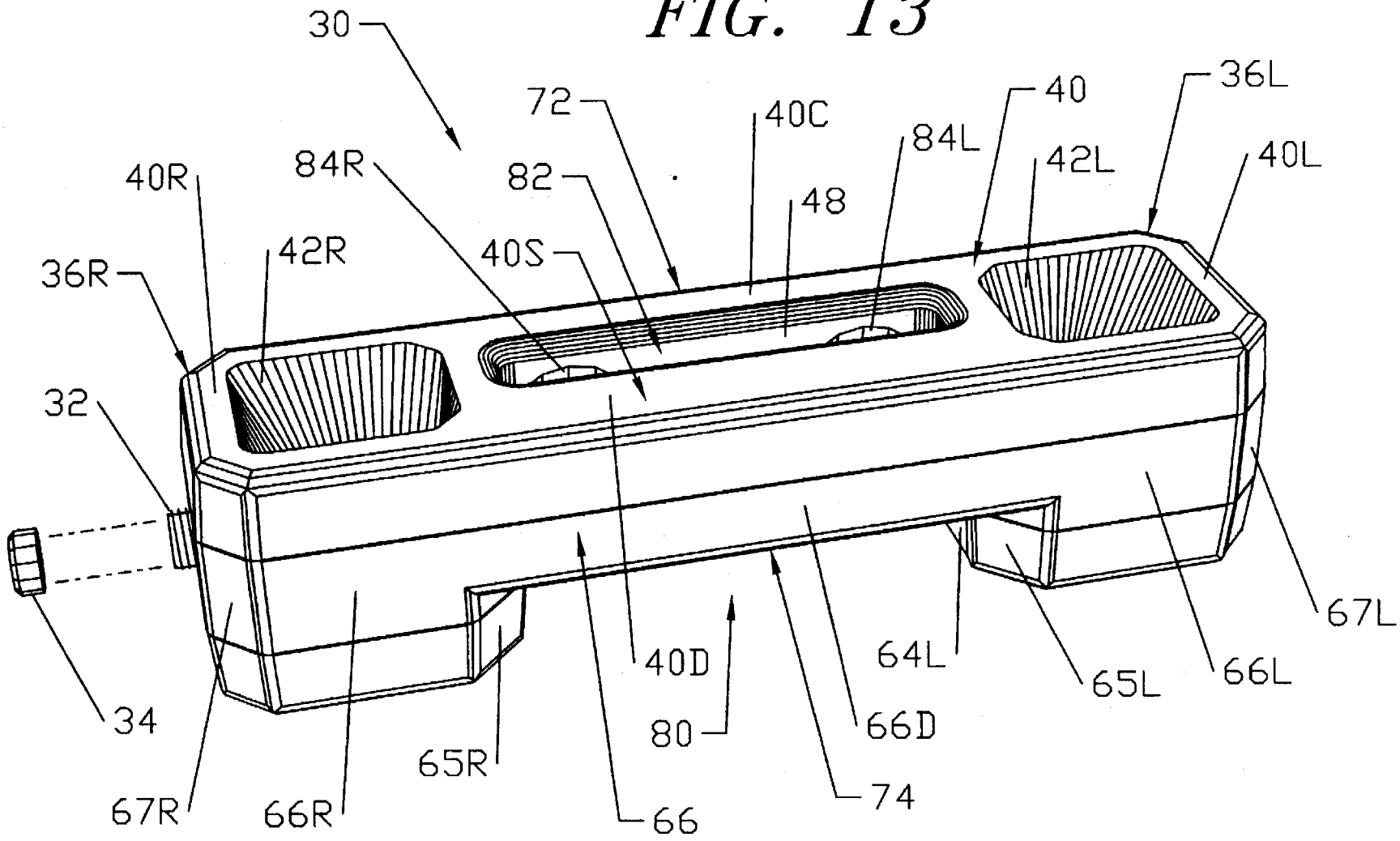
FIG. 13 is a perspective view of the third embodiment of the present invention, taken from the upper fight rear.

A third embodiment, shown in FIGS. 12 and 13, is similar to the first embodiment, except that in this embodiment, transverse members 72 and 74 are thicker from front to rear, and taller from top to bottom. Front transverse surface 62C is flush and coplanar with front surfaces 62L and 62R, not inset toward the rear, so that these three surfaces together form one continuous front surface 62. Rear transverse surface 66D is flush and coplanar with rear surfaces 66L and 66R, not inset toward the front, so that these three surfaces together form one continuous rear surface 66. Top transverse surfaces 40C and 40D are flush and coplanar with top surfaces 40L and 40R, not inset downward, so that these four surfaces together form one continuous top surface 40.

Figure 14:
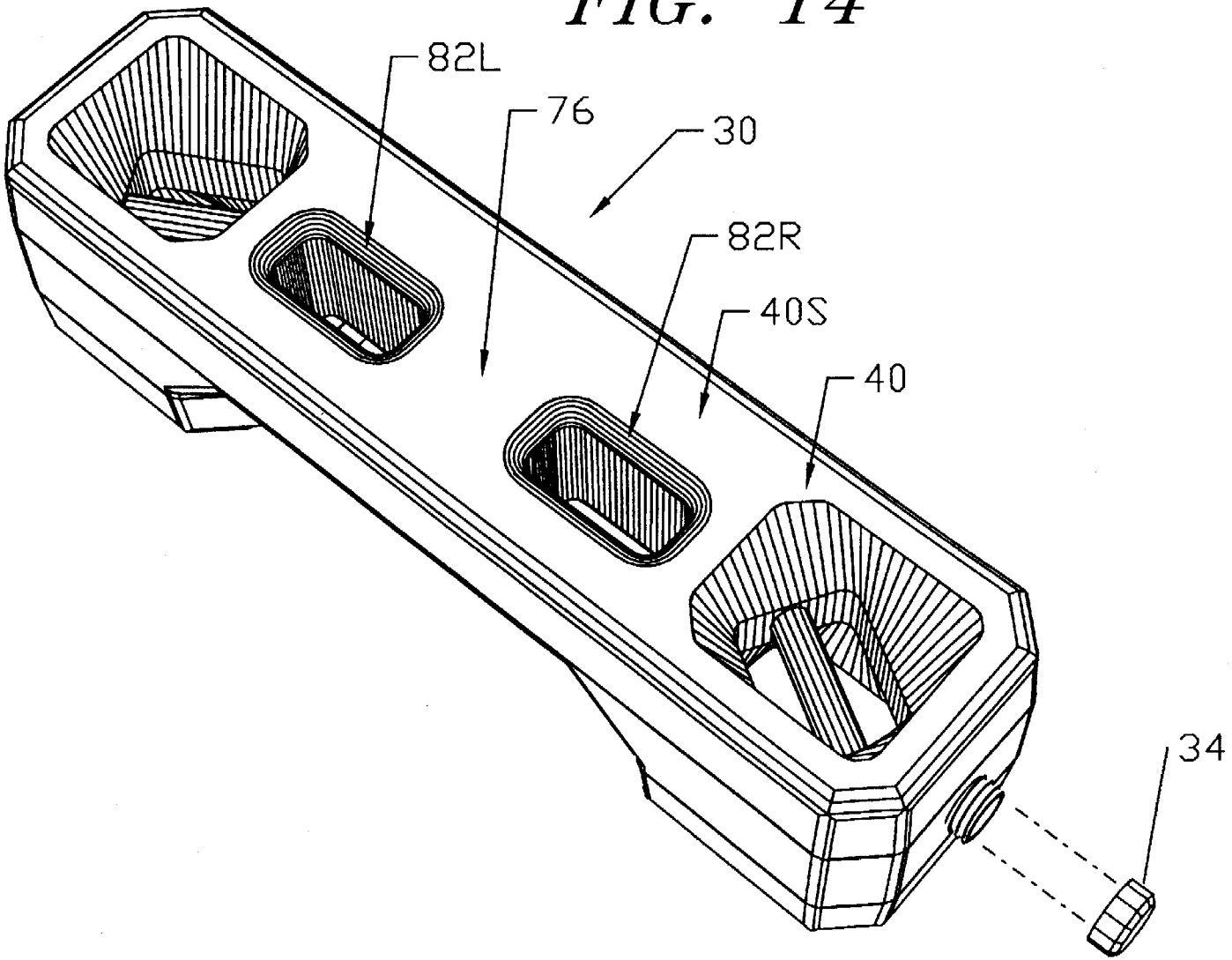
FIG. 14 is a perspective view of the fourth embodiment of the present invention, taken from the upper fight front.

A fourth embodiment, shown in FIG. 14, is similar to the third embodiment, while also incorporating the middle connecting member 76 and dual foot insertion voids 82L and 82R of the second embodiment.

Figure 15:
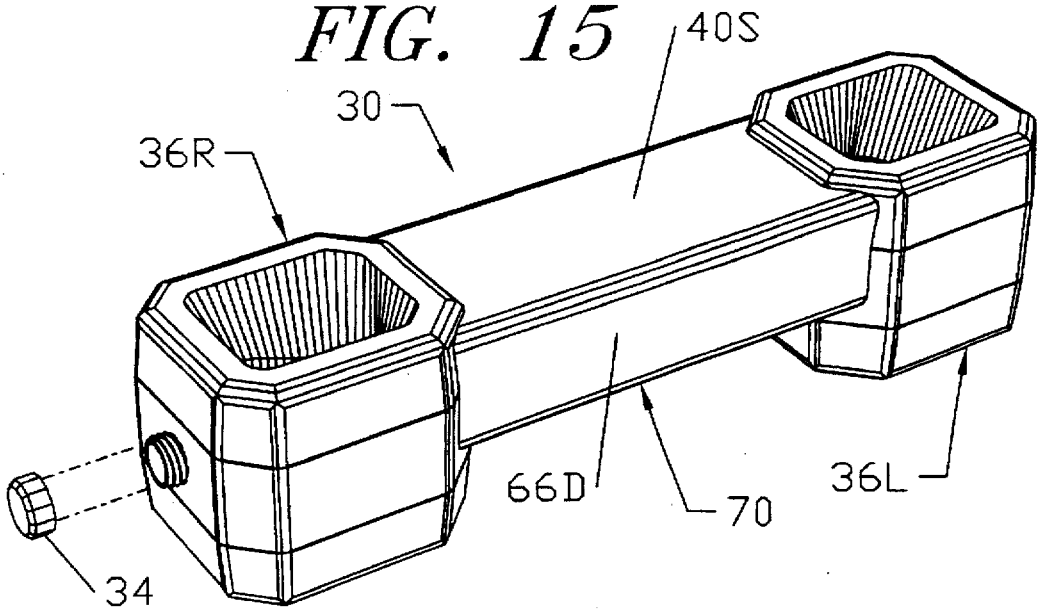
FIG. 15 is a perspective view of the fifth embodiment of the present invention, taken from the upper fight rear.
Figure 16:
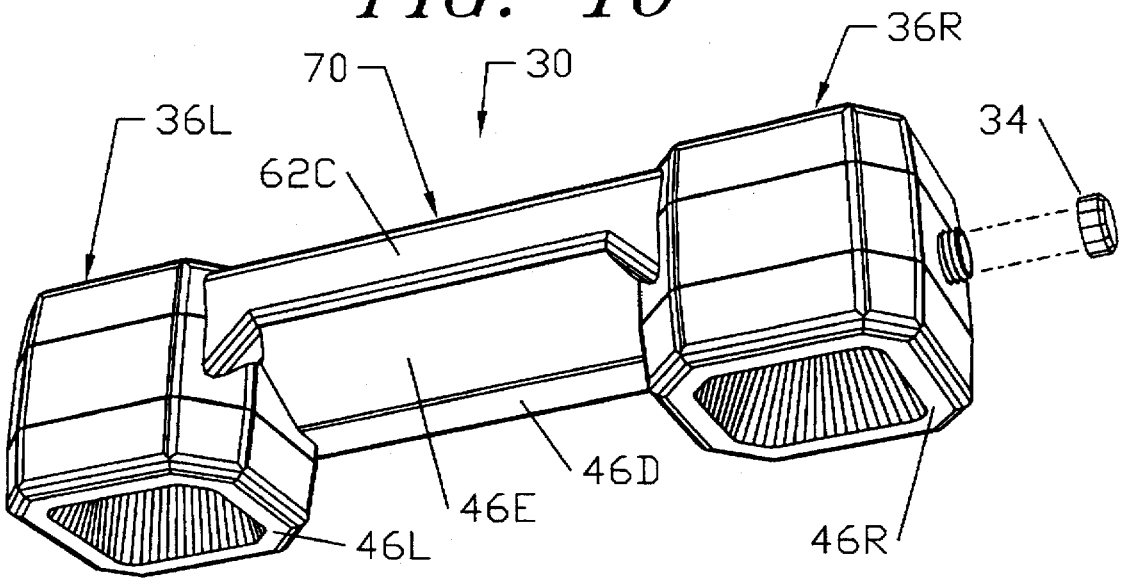
FIG. 16 is a perspective view of the fifth embodiment of the present invention, taken from the lower fight front.

A fifth embodiment, shown in FIGS. 15 and 16 is similar to the first embodiment described above, except that it incorporates no foot insertion recesses whatever. This embodiment incorporates a single transverse member 70, rather than the front and rear transverse members 72 and 74 of the previously described embodiments. This single transverse member has a top stepping surface 40S, a front transverse surface 62C, bottom transverse surfaces 46D and 46E, and a rear transverse surface 66D. Front transverse surface 62C is inset rearward from front surfaces 62L and 62R. Rear transverse surface 66D is inset frontward from rear surfaces 66L and 66R. Top stepping surface 40S is inset downward from top surfaces 40L and 40R. Top stepping surface 40S may be provided with a nonskid textured surface or may incorporate longitudinal grooves or other geometrical relief pattern for added strength and traction.

Usage and Operation

Figure 17:
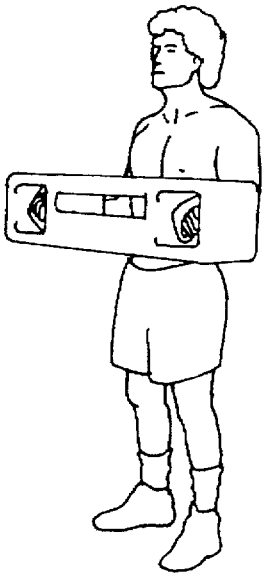
FIG. 17 shows a user performing a curl with the present invention.

The present invention may be used in a variety of exercises, engaged by either the hands or the feet. As illustrated in FIGS. 17–30, herein are some examples:

As shown in FIG. 17, by gripping the handles with the palms turned upward, with the device oriented so that the trunk accomodation cutout is disposed toward the user, and the outside ends of the handles are angled upward, a user may advantageously employ the device in the performance of traditional curls.

Figure 18:
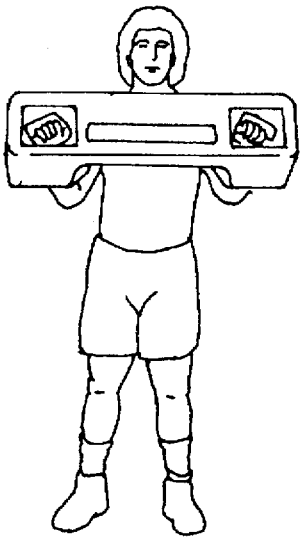
FIGS. 18 and 19 show a user performing an overhead press with the present invention.
Figure 19:
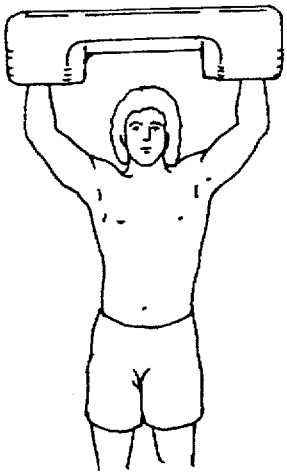
Figure 20:
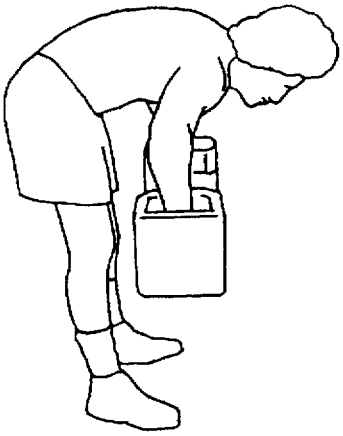
FIG. 20 shows a user performing bent over rows with the present invention.
Figure 21:
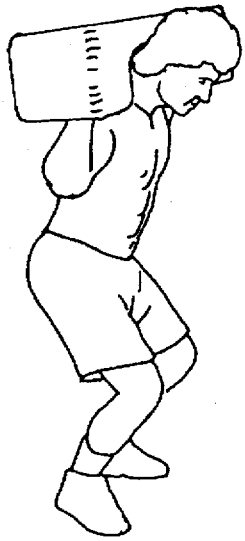
FIGS. 21 and 22 show a user performing squats with the present invention.
Figure 22:
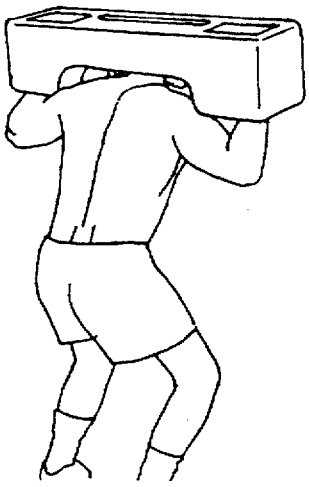

By gripping the handles with the palms turned downward, with the device oriented so that the trunk accomodation cavity is disposed toward the user, and the outside ends of the handles are angled downward, the user may perform standard overhead presses as shown in FIGS. 18 and 19. Using this same grip, a user may perform behind the neck presses and arm extensions, the final overhead positions of which are illustrated in FIG. 19 or, bending forward at the waist, the user may perform bent-over rows as in FIG. 20. Again using this same grip, and holding the device behind the head, resting on the shoulders, the device may be advantageously employed in the performance of squats, as shown in FIGS. 21 and 22.

Figure 23:
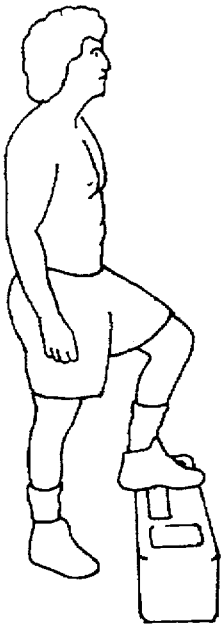
FIG. 23 shows a user performing a stair stepping exercise with the present invention.

As shown as FIG. 23, with the device resting on a floor and oriented so that the stepping surface is facing upward, the device may be advantageously employed in the performance of stair stepping type exercises. These exercises may be aerobic in nature, or may utilize other freeweights, including but not limited to a second unit of the present invention.

Figure 24:
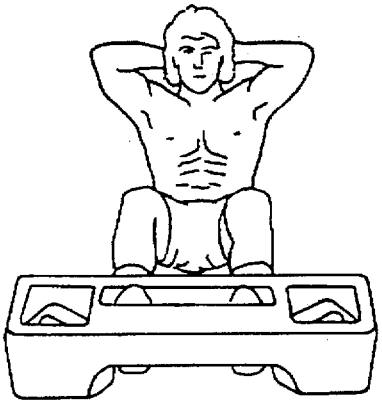
FIG. 24 shows a user performing a situp, utilizing the present invention to hold down the feet.
Figure 25:
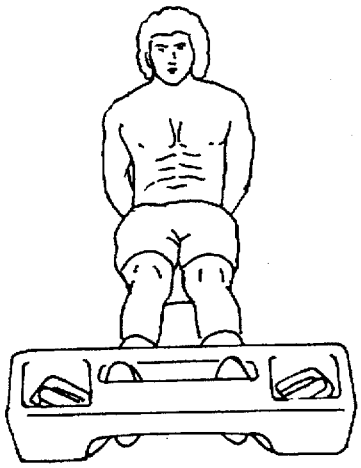
FIGS. 25 and 26 show a user performing leg extensions with the present invention.
Figure 26:
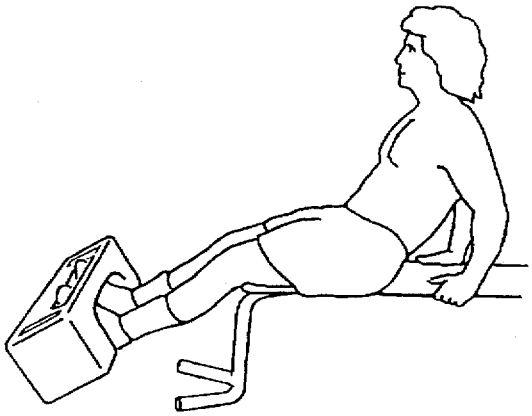
Figure 27:
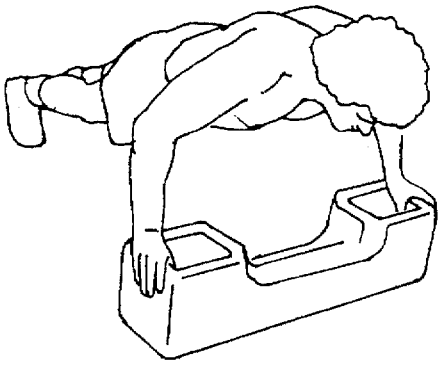
FIG. 27 shows a user performing a pushup with the hands gripping the outer edge of the present invention.

By sitting in front of the device, and inserting the feet, toe first from below into the foot insertion voids, as in FIG. 24, a user is able to perform situps with enhanced ease and effectiveness, as the device performs the function of holding down the feet. The device conveniently rolls to the angle most comfortable for the user. By inserting the feet in the same way, but from an elevated sitting position, such as on a bench, with the lower legs hanging over the edge, the user is able to perform leg extensions, as illustrated in FIGS. 25 and 26.

Figure 28:
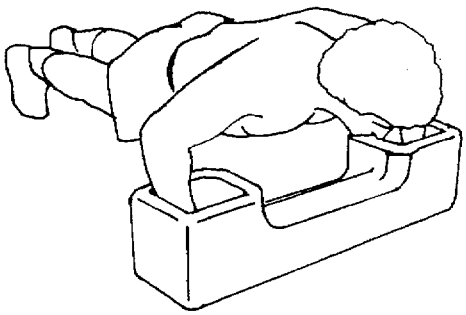
FIG. 28 shows a user performing a pushup with the hands gripping the handles of the present invention.
Figure 29:
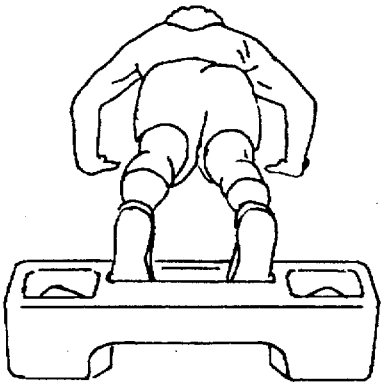
FIGS. 29 and 30 show a user performing pushups with the feet inserted into the foot insertion voids of the present invention.
Figure 30:
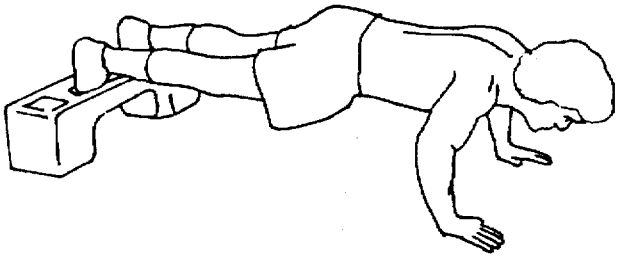

The device is quite effective in enhancing the performance of pushups: With the device oriented so that the trunk accomodation cutout is facing upward, the user grips the outside edges as in FIG. 27. This position allows enhanced extension at the lower end of the pushup movement. In FIG. 28, with the device oriented the same way, a user grips the device by the handles. This position provides positively anchored hand placement in the performance of pushups. By inserting the feet toe first from above into the foot insertion void, with the device oriented so that the trunk accomodation cutout faces down, as in FIGS. 29 and 30, a user is in a position for performing pushups of greatly enhanced effectiveness. Not only are the feet elevated, which slightly increases the average resistance during the pushup, but the positive anchoring of the feet serves as a fulcrum for a smooth, definitive, and consistent motion.

The above uses represent only a sampling of the exercises possible using the present invention. Not only is it convenient for virtually any exercise normally performed with a conventional barbell or easy-curl bar, but due to increased ergonomics and comfort, it is actually superior for many uses, especially those that require contact with the trunk, pelvis, or shoulders. In addition, the device may be used as a bench or stool for the user to sit or lay upon when using freeweights or a second unit of the present invention to exercise. The device may be emptied for transport, and even used as an interim container for other materials, such as foodstuffs, fuel, or beverages, making it an ideal fitness device for use when traveling, or on extended maneuvers, forays, missions, expeditions, or camping trips. In the first and third embodiments discussed above, the present invention may be conveniently carried in one hand by gripping it at the midpoint of the front transverse member.

Conclusion, Ramifications, and Scope of Invention

Thus the reader will see that the present invention provides an inexpensively manufactured, multiple use exercise device which can be shipped or transported in a lightweight state, and conveniently filled with a ballast substance such as water by the end user to impart mass sufficient to facilitate the myriad of uses for which it is designed. Since the size of the unit as a whole, as well as proportions and volumes of its regions may be varied while staying within the overall scope of the invention, it will be possible to produce units in a variety of sizes and weights to suit the fitness needs of a multiplicity of users.

While the above description contains many specificities, these should not be construed as limitations on the scope of the invention, but rather as exemplification of five preferred embodiments thereof. Many other variations are possible, without departing from the overall spirit of the invention, for example:

The handles could be mounted at a different angle than that discussed above;

More handles and hand access recesses could be incorporated in the middle instead of foot insertion voids;

The hand access recesses and handles could be omitted from a version of the present invention which would be directed toward engagement by the feet only;

The present invention could be cast or machined as a single solid, as opposed to a fillable hollow container;

The threaded fill nozzle and cap could be replaced by a permanent fill plug, with the present invention being filled with a permanent ballast substance or a cementitious hardening solid at the point of manufacture;

The present invention could have one or more decorative textures, patterns, or markings molded into the surface;

Structural ribs, folds, creases, grooves, or panels could be molded into one or more surfaces of the invention;

Having writing, brand recognition markings, instructional text or diagrams, or trademark graphics integrally molded into the surface could enhance the appearance or utility of this invention;

This general design could incorporate rotatable, or swivel mounted handles, or handles mounted within a gimbal assembly;

The interfaces between the end panels, and the front and back panels could be chamfered, but not filleted, so that the present invention could be stood on its end with enhanced stability;

A device having the general attributes of the embodiments described above, but with a more curved, less squared off shape, or a shape exhibiting less parallelism between its component regions might be more ergonomic or pleasing to the eye;

A set containing various sizes, and therefore different weights of one or more of the embodiments described would be desirable for some users.

Accordingly, the scope of the invention should be determined not by the embodiments illustrated, but by the appended claims and their legal equivalents.

What is claimed is:

1. A combination barbell and step exercise apparatus, comprising:

an oblong structure for providing a mass for lifting in free-weight exercise, the oblong structure having opposed ends, a plurality of sides, and a center of mass;

a pair of recess penetrating the oblong structure on one side thereof proximate each opposed end thereof;

a handle within each said recess approximately along a longitudinal axis of the oblong structure passing through the center of mass thereof whereby the oblong structure may be grasped and lifted in the manner of a barbell;

the oblong structure further having opposed top and bottom surfaces, the portion of the top surface between the recesses being substantially flat for use as a step in step-type exercise, the bottom surface being substantially parallel to the top surface for providing a stable base during step-type exercise.

2. The combination barbell and step exercise apparatus of claim 1, wherein the pair of recesses penetrate the oblong structure through to a side opposite said one side.

3. The combination barbell and step exercise apparatus of claim 1, wherein said one side comprises a central cutout between the recesses for accommodating the trunk of a user.

4. The combination barbell and step exercise apparatus of claim 1, wherein the oblong structure comprises a hollow shell for containing a ballast, the shell having an orifice for introducing a ballast thereinto and means for closing the orifice.

5. The combination barbell and step exercise apparatus of claim 9, wherein said hollow shell is fashioned from blow-molded material.

6. The combination barbell and step exercise apparatus of claim 5, wherein the pair of recesses penetrate the oblong structure through to a side opposite said one side.

7. The combination barbell and step exercise apparatus of claim 1, wherein a portion of one surface of said oblong structure between the recesses has at least one void for receiving the toes of a user's feet from above so as to support the feet of a user above the floor during execution of pushups, a surface opposite said one surface being substantially flat for providing a base during execution of pushups.

8. The combination barbell and step exercise apparatus of claim 1, wherein a portion of one surface of said oblong structure between the recesses has at least one void for receiving the toes of a user's feet from below so as to anchor the feet of a user during execution of situps.

9. The combination barbell and step exercise apparatus of claim 8, wherein said at least one void penetrates the oblong structure through to a surface opposite said one surface for receiving the toes of a user's feet from above so as to support the feet of a user above a surface during execution of pushups, a surface opposite said one surface being substantially flat for providing a base during execution of pushups.

10. The combination barbell and step exercise apparatus of claim 1, wherein said handles are angled with respect to said longitudinal axis.

11. The combination barbell and step exercise apparatus of claim 1, wherein the portion of the top surface between the recesses comprises a non-skid surface.

12. A barbell facilitating execution of pushups, comprising:

an oblong structure for providing a mass for lifting in free-weight exercise, the oblong structure having opposed ends, a plurality of sides and a center of mass;

a pair of recess penetrating the oblong structure on one side thereof proximate each opposed end thereof;

a handle within each said recess approximately along a longitudinal axis of the oblong structure passing through the center of mass thereof whereby the oblong structure may be grasped and lifted in the manner of a barbell;

the oblong structure further having opposed top and bottom surfaces, a portion of the top surface between the recesses having at least one void for receiving the toes of a user's feet from above so as to support the feet of a user above a surface during execution of pushups, the bottom surface being substantially flat for providing a base during execution of pushups.

13. The barbell of claim 12, wherein the pair of recesses penetrate the oblong structure through to a side opposite said one side.

14. The barbell of claim 12, wherein said one side comprises a central cutout between the recesses for accommodating the trunk of a user.

15. The barbell of claim 12, wherein the oblong structure comprises a hollow shell for containing a ballast, the shell having an orifice for introducing a ballast thereinto and means for closing the orifice.

16. The barbell of claim 15, wherein said hollow shell is fashioned from blow-molded material.

17. The barbell of claim 16, wherein the pair of recesses penetrate the oblong structure through to a side opposite said one side.

18. The barbell of claim 15, wherein the portion of the top surface between the recesses is substantially flat for use as a step in step-type exercise, the bottom surface being substantially parallel the top surface for providing a stable base during step-type exercise.

19. The barbell of claim 18 wherein the portion of the top surface between the recesses comprises a non-skid surface.

20. The barbell of claim 15, wherein said at least one void penetrates the oblong structure through to the bottom surface for receiving the toes of a user's feet from below so as to anchor the feet of a user during execution of situps.

21. The barbell of claim 12, wherein said handles are angled with respect to said longitudinal axis.

22. A barbell facilitating execution of situps, comprising:

an oblong structure for providing a mass for lifting in free-weight exercise, the oblong structure having opposed ends, a plurality of sides and a center of mass;

a pair of recess penetrating the oblong structure on one side thereof proximate each opposed end thereof;

a handle within each said recess, approximately along a longitudinal axis of the oblong structure passing through the center of mass of thereof, whereby the oblong structure may be grasped and lifted in the manner of a barbell; and a portion of one surface of the oblong structure having a central cutout for accommodating the feet of a user between the recesses and at least one void within the central cutout for receiving the toes of a user's feet from below so as to anchor the feet of a user during execution of situps.

23. The barbell of claim 22, wherein the pair of recesses penetrate the oblong structure through to a side opposite said one side.

24. The barbell of claim 22, wherein the oblong structure comprises a hollow shell for containing a ballast, the shell having an orifice for introducing a ballast thereinto and means for closing the orifice.

25. The barbell of claim 24, wherein said hollow shell is fashioned from a blow-molded material.

26. The barbell of claim 25, wherein the pair of recesses penetrate the oblong structure through to a side opposite said one side.

27. The barbell of claim 24, the oblong structure further having opposed top and bottom surfaces, a portion of the top surface between the recesses being substantially flat for use as a step in step-type exercise, the bottom surface being substantially parallel the top surface for providing a stable base during step-type exercise.

28. The barbell of claim 27, wherein the portion of the top surface between the recesses comprises a non-skid surface.

29. The barbell of claim 27 wherein said at least one void penetrates the oblong structure through to a surface opposite said one surface for receiving the toes of a user's feet from above so as to support the feet of a user above a surface during execution of pushups, a portion of said one surface being substantially flat for providing a base during execution of pushups.

30. The barbell of claim 29, wherein the pair of recesses penetrate the oblong structure through to a side opposite said one side.

* * * * *